United States Patent [19]

Rosenberg

[11] Patent Number: 5,044,636

[45] Date of Patent: Sep. 3, 1991

[54] GAME APPARATUS FOR RANDOMLY DISPLAYING GRADEABLE CHARACTERISTICS

[76] Inventor: Lorie Rosenberg, 2171 SW. 117th Ter., Davie, Fla. 33325

[21] Appl. No.: 503,787

[22] Filed: Apr. 3, 1990

[51] Int. Cl.[5] ..... A63F 9/00

[52] U.S. Cl. ..... 273/138 A

[58] Field of Search ..... 273/138 A, 139, 1 GC, 273/1 E, 161

[56] References Cited

U.S. PATENT DOCUMENTS 2,587,381 2/1952 Peterson ..... 273/1 GC
4,169,592 10/1979 Hall ..... 273/1 E
4,298,198 11/1981 Huang et al. ..... 273/1 GC
4,326,721 4/1982 Minami et al. ..... 273/1 GE X
4,358,118 11/1982 Plapp ..... 273/1 GC X
4,783,073 11/1988 Kazumi ..... 273/138 R X

*Primary Examiner*—William H. Grieb
*Attorney, Agent, or Firm*—Caesar, Rivise, Bernstein, Cohen & Pokotilow, Ltd.

[57] ABSTRACT

A game apparatus comprising a plurality of display sectors each having a label expressing a characteristic, an illuminating device for illuminating a selected one of the display sectors, and a display selector selecting device connected to the illuminating device for randomly selecting one of the display sectors to be illuminated.

15 Claims, 2 Drawing Sheets

FIG. 1
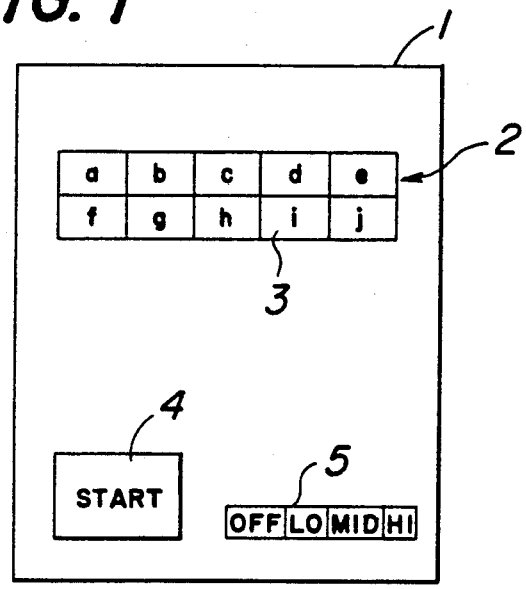
FIG. 2
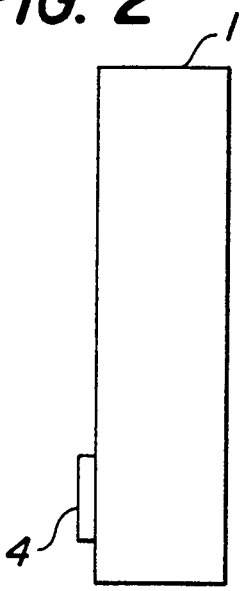
FIG. 3
| AWFUL | BAD | TOLER ABLE | FAIR | HO-HUM |
|---|---|---|---|---|
| O K | NICE | GOOD | FINE | TER RIFIC |
6
FIG. 4
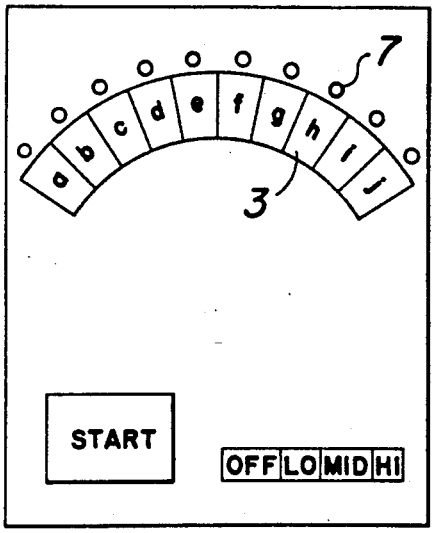
FIG. 6
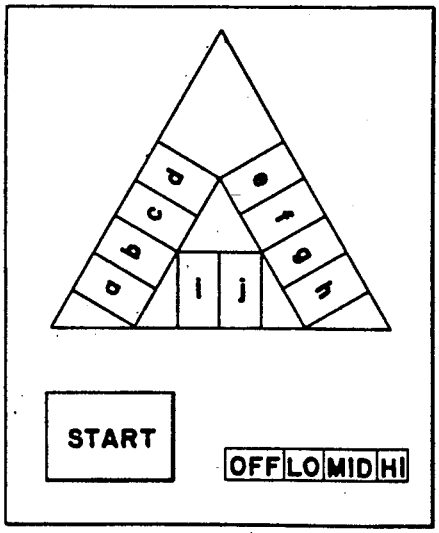

GAME APPARATUS FOR RANDOMLY DISPLAYING GRADEABLE CHARACTERISTICS

The invention relates to game playing devices and more particularly to a game playing apparatus that includes a number of display sectors that are labeled with any one of a number of characteristics, of which any one can be randomly selected to display a selected characteristic.

BACKGROUND OF THE INVENTION AND PRIOR ART

With the advent of electronic technology, a number of game devices have become known, which operate to amuse users thereof and to test various skills such as related to speed of reflexes and/or the memory of players or other skills.

Typical of such game devices is U.S. Pat. No. 4,169,592, which discloses an electronic reflex game, and U.S. Pat. No. 4,358,118, which discloses an electronic game that senses physiological responses of players.

The instant invention is a game apparatus that seeks to entertain a group of players by randomly or directedly selecting and displaying any one of a number of personal characteristics that can be labeled and arranged advantageously on a graded scale. Typical of such gradeable characteristics are personal looks, intelligence, knowledge, wit and so forth.

SUMMARY OF THE INVENTION

The invention is accordingly a game device typically in the form of a small hand-held unit, approximately the size of a pocket calculator. It is intended for entertainment and amusement in a social setting.

The device typically has a front face plate that includes: a display with a plurality of display sectors, each having a label in the form of a statement, legend, color or symbol representing a characteristic or sentiment that can be arranged, for example, on a random or graded scale from a high to a low value; a start button and a mode switch with at least four positions, namely OFF, LOW, MIDDLE, HIGH, and electronic circuitry connecting together the display sectors, the start button and the slide switch.

In operation, with the mode switch set to middle position, the start button is depressed for a moment; the electronic circuit starts a timer which enables a clock generator to run while the timer runs; the clock generator drives a recirculating counter having at most as many counts as the number of display sectors. When the timer runs out, the clock generator stops running and the counter stays on the last count reached, when the clock generator stopped. The counter will stop randomly in any sector, since the running time includes the time the start button is depressed plus the time lapse set by the counter.

In accordance with the inventive concept, there is provided a game apparatus which includes a plurality of display sectors each having a label expressing a gradeable characteristic, illuminating elements for illuminating one of the display sectors, and display sector selecting elements connected to the illuminating element for randomly selecting one of the display sectors to be illuminated.

According to a further feature, there is provided a game apparatus wherein the illuminating means include at least one of a liquid crystal display, a light-emitting diode display and an incandescent bulb display.

In accordance with still a further feature, there is provided a game apparatus wherein the display sectors are disposed along a rectangular perimeter, or alternatively wherein the display sectors are disposed along a circular, triangular, curved or arcuate perimeter.

The game apparatus according to the invention may be arranged such that the display sectors are divided into a high group of sectors, a low group of sectors and a middle group of sectors according to a grade assigned to the respective display sector.

The game apparatus according to the invention may further include a start button connected to the selecting elements, and a mode selecting switch connected to the selecting elements, wherein the mode selecting switch may have a high mode position, a low mode position and a middle mode position for respectively selecting a display sector in the high group, the low group or in the middle group for display upon release of the start button.

There may further be provided a game apparatus wherein the selecting elements include pulse generating elements connected to the start button, a counter which has an input connected to the pulse generating elements, and inputs to the display sectors connected to the counter for displaying a sector corresponding to a count stored in the counter upon release of said start button, and wherein the pulse generating elements include a fast pulse generator having an input connected to the start button, a slow pulse generator having an input, a timer having an input connected to the start button and an output connected to the input of the slow pulse generator, and a mode selecting circuit connected between the pulse generating elements and the display sectors, having inputs connected to the mode selecting switch for randomly selecting a display sector in the middle group upon release of the start button elapse of a time interval determined by the timer.

According to again a further feature, there may be provided a game apparatus which includes a transparent overlay for overlaying the game apparatus, and which overlay has imprinted thereon labels for the display sectors.

Other features which are considered as characteristic for the invention are set forth in the appended claims.

Although the invention is illustrated and described herein as embodied in a game apparatus for randomly displaying gradeable characteristics, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

FIG. 1 is a front view of the face of the game device, showing the display sectors, a start button and a mode selecting switch;

FIG. 2 is a side view of the game device;

FIG. 3 is an exemplary view of the display sectors with labels arranged in a graded order;

FIG. 4 is another front view of the game device, showing the display sectors arranged along a circle sector.

FIG. 6 is another view of the game device, showing the display sectors arranged along a triangular perimeter.

DESCRIPTION OF THE PREFERRED EMBODIMENTS

Figure 5:
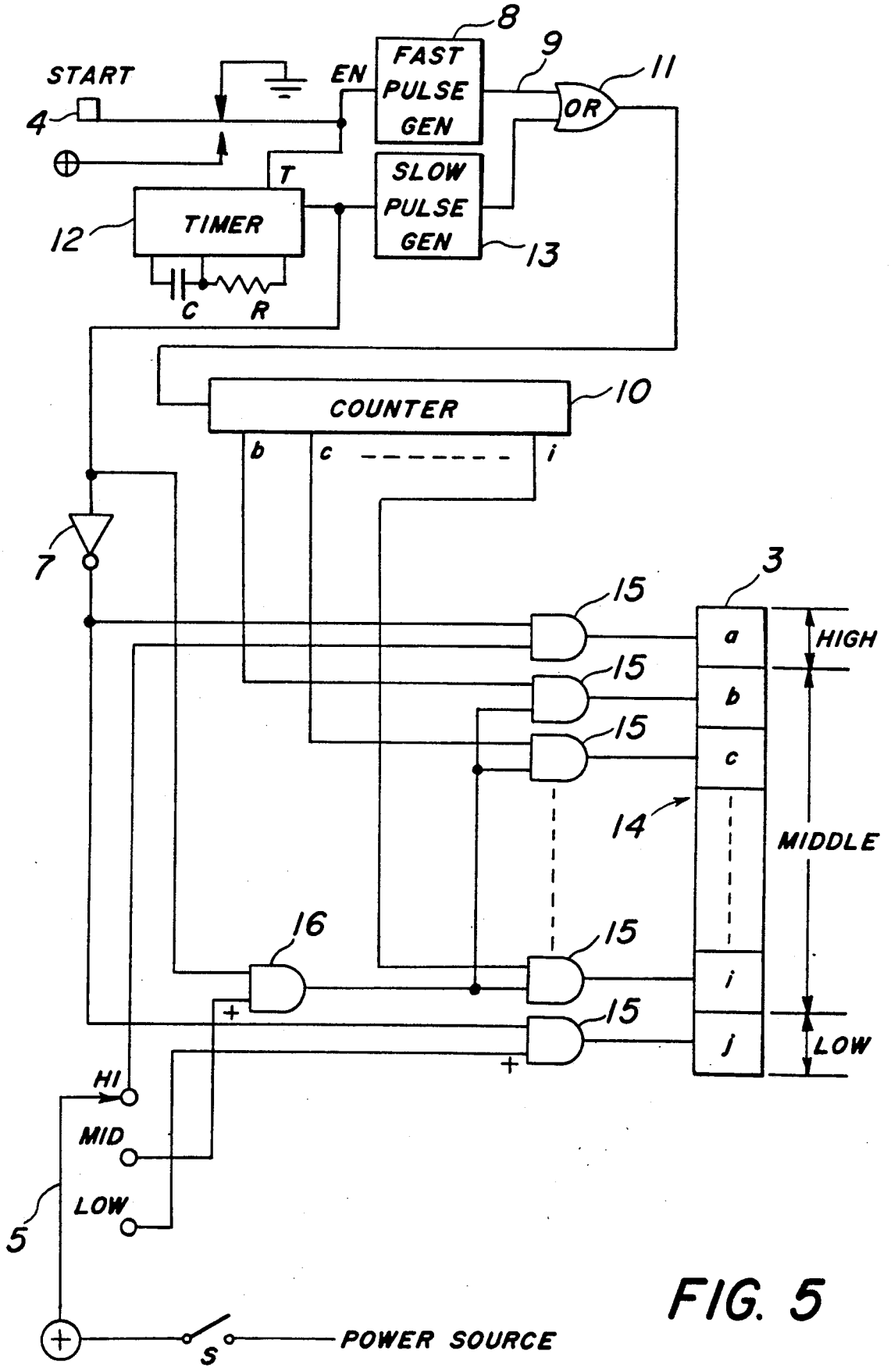
FIG. 5 is a schematic circuit diagram of the electronic circuit of the game device.

The device is shown in one of its preferred embodiments in FIGS. 1 and 2, wherein FIG. 1 is a front view showing the device 1 having a display 2 with a number of display sectors 3 labeled a–j; a start button 4 and a four position mode selection switch 5. FIG. 2 is a side view of the device.

FIG. 3 shows as an example the display sectors each given a legend on a graded scale from "AWFUL" at the low end of the scale to "TERRIFIC" at the high end.

It follows that the number of display sectors can be arbitrarily chosen, as well as the size and shape of the display, and the actual wording of the legends on the sectors.

For example, in addition to locating the display sectors along a rectangular perimeter, as is illustrated in FIGS. 1 and 3, the display sectors can be disposed along a curved perimeter (e.g., FIG. 4) or a triangular perimeter (e.g., FIG. 6).

It is contemplated that an optional replaceable transparent overlay with printed legends and symbols and the like can be provided and placed over the display sectors.

With the mode selector switch 5, having a high, middle and low position, in its LOW position, the final display will always stop on the lowest graded sector in the example according to FIG. 3 shown as "AWFUL", and with the mode selector switch 5 in HIGH position, it will always stop on the highest graded sector shown as "TERRIFIC". With the mode selector switch 5 in MIDDLE position, it will stop randomly on any of the sectors between b and i, and not on display sectors a or j.

The display sectors 3 can be realized as liquid crystal (LCD) displays, light-emitting diode (LED) displays or incandescent bulb displays. With the latter two displays, an LED or bulb may be placed within or near the respective sector, as shown in FIG. 4 wherein an LED or bulb 7 is associated with each sectors a–j. Use of LED's (FIG. 4) allows a choice in the shape of the display, but requires more battery current. An LCD display offers very low current drain, but will advantageously be rectangular in shape, and is somewhat more expensive.

FIG. 5 is an example of a schematic circuit diagram of the electronic circuit for the invention. First, the mode switch 5 is set to one of the modes (LOW), Middle (MID) or High (HI), and simultaneously via switch S battery power is connected to the power pins of the circuit elements and selects the proper mode. Alternatively, switch S is coupled to start button 4 for connecting battery power on, and coupled to mode selector switch 5 for turning power off. Assuming the middle mode MI is selected, and the start button 4 is depressed, a fast pulse generator 8 is started by a logic 1 in the form of plus battery on input EN of the fast pulse generator 8, which starts to run at high speed, e.g. 1 Mega Herz and keeps running while the start button 4 is depressed. During this period a counter 10 is kept running driven by output 9 of pulse generator 8 via OR-gate 11 to a certain count depending upon how long the start button 4 is held. After release of the start button 4, a timer 12, e.g. in the form of an 555-type timer having timing elements C and R, is started as its trigger input T goes from high to low. The timer 12 may be set for e.g. 1 second and enables a slow pulse generator 13 that runs at e.g. 15 Herz, which drives the counter 10 at a low speed which is visible on the display 14 with display sectors 3 labeled a–j. After the elapse of the time determined by the timer 12, the display will illuminate one of the sectors 3 which will be randomly selected as determined by the length of time the start button was operated.

If, however, the mode selection switch 5 is set to LOW (or HI), the display will be seen running while the timer and the slow pulse generator run, but at the end of timing all display sectors will be extinguished except only sector a (or j) will be illuminated, as determined by a number of logic elements which typically include AND-gates, OR-gates, NAND-gates, inverters and amplifiers, as described in more detail in the following paragraph.

All outputs b–i of counter 10 are connected via an upper input of AND-gates 15 to respective display sectors b–i. Assuming that the mode selector switch is in its middle position MID, the lower input of AND-gate 16 is enabled, while its upper input is also enabled by the output of the timer 12, while the timer is active. While AND-gate 16 is active, its output enables the lower input of those AND-gates 15 that control display sectors b–i, which will be seen as flashing while the counter 10 is running, driven by the slow pulse generator 13. When the timer returns to normal, one of the display sectors b–i will remain on, depending on where the counter stops. If, however, the selector switch 5 is in either LOW or HI position, the respective high sector a or low sector j will come on when the upper input of AND-gates 15, which control upper and lower sector a or j, is enabled via inverter 17, when the timer 12 resets to normal.

I claim:

1. A game apparatus comprising a plurality of display sectors each having a label expressing a characteristic, indicator means for indicating one of said display sectors, and user-actuatable display sector selecting means connected to said indicator means for either randomly selecting one of said display sectors to be indicated or directly selecting one of said display sectors to be indicated.

2. A game apparatus according to claim 1, wherein the indicator means is an illuminating means for illuminating one of said display sectors.

3. A game apparatus according to claim 2, wherein said illuminating means include one of a liquid crystal display, a light-emitting diode display and an incandescent bulb display coupled to said sectors.

4. A game apparatus according to claim 1, wherein said display sectors are disposed along at least one of a rectangular, triangular and curved perimeter.

5. A game apparatus according to claim 1, wherein said display sectors are disposed along a circle segment perimeter.

6. A game according to claim 1, including a transparent overlay for overlaying said game apparatus, said overlay having imprinted thereon said labels for said display sectors.

7. A game apparatus according to claim 6, wherein said transparent overlay is detachably attached to said game apparatus.

8. A game apparatus according to claim 1 including means for turning battery power on and off.

9. A game apparatus according to claim 1, in the form of a hand-held unit.

10. A game apparatus according to claim 1, wherein said plurality of display sectors includes one group from which a display sector is randomly selectable and a second group from which a display sector is directly selectable.

11. A game apparatus of claim 10, wherein each of the display sectors of said one group is different from each of the display sectors in said second group.

12. A game apparatus according to claim 11, wherein said plurality of display sectors are arranged from high-to-low according to a gradeable characteristic assigned to each respective display sector, the second group of display sectors consisting of the display sectors indicating the highest and lowest gradeable characteristics and the first group of the display sectors including a plurality of display sectors between the display sectors with the highest and lowest gradeable characteristics.

13. A game apparatus according to claim 12, wherein said selecting means includes a start button and a mode selecting switch, said mode selecting switch having a high mode position, a low mode position and a middle mode position for respectively selecting the display sector with the highest gradeable characteristic, the display sector with the lowest gradeable characteristic and one of said display sectors between the display sectors with the highest and lowest gradeable characteristics upon release of said start button.

14. A game apparatus according to claim 13, wherein said selecting means include pulse generating means connected to said start button, a counter having an input connected to said pulse generating means, and inputs to said display sectors connected to said counter for displaying a sector corresponding to a count stored in said counter upon release of said start button.

15. A game apparatus according to claim 14, wherein said pulse generating means include a fast pulse generator having an input connected to said start button, a slow pulse generator having an input, a timer having an input connected to said start button and an output connected to said input of the slow pulse generator, and a mode selecting circuit connected between said pulse generating means and said display sectors, having inputs connected to said mode selecting switch for randomly selecting a display sector in said display sectors between the display sectors with the highest and lowest gradeable characteristics upon release of said start button and elapse of a time interval determined by said timer.

* * * * *